US006003157A

United States Patent [19]

Bruyere

[11] Patent Number: 6,003,157

[45] **Date of Patent: *Dec. 21, 1999**

[54] DEVICE FOR DEODORIZING AIR FROM A TOILET

[76] Inventor: Leonard Bruyere, 9 Cedar Grove, Wright City, Mo. 63390

[ * ] Notice: This patent issued on a continued prosecution application filed under 37 CFR 1.53(d), and is subject to the twenty year patent term provisions of 35 U.S.C. 154(a)(2).

[21] Appl. No.: 08/700,232

[22] Filed: Aug. 20, 1996

Related U.S. Application Data

[63] Continuation-in-part of application No. 08/405,215, Mar. 16, 1995, abandoned.

[51] Int. Cl.[6] ..... E03D 9/052

[52] U.S. Cl. ..... 4/213; 15/327.6; 15/347

[58] Field of Search ..... 4/347, 348, 349, 4/350, 351, 352, 213, 216, 217; 15/327.6, 347

[56] References Cited

U.S. PATENT DOCUMENTS

| | | | |
|---|---|---|---|
| 1,736,467 | 11/1929 | Sarrett | 4/213 |
| 1,798,457 | 3/1931 | Cole | 4/213 |
| 2,017,590 | 10/1935 | Duffner | 4/213 |
| 2,747,201 | 5/1956 | Herriott | 4/213 |
| 3,366,979 | 2/1968 | Johnston | 4/213 |
| 4,876,748 | 10/1989 | Chun | 4/213 |
| 5,161,262 | 11/1992 | Quaintance, Sr. | 4/213 |
| 5,454,122 | 10/1995 | Bergeron | 4/213 |

FOREIGN PATENT DOCUMENTS

| | | | |
|---|---|---|---|
| 331192 | 9/1989 | European Pat. Off. | 4/213 |
| 187430 | 8/1991 | Japan | 4/348 |

OTHER PUBLICATIONS

Purafil, Inc., Purafil Odoroxidant Media, Sales Bulletin #126, Nov. 1990.

*Primary Examiner*—Charles R. Eloshway
*Attorney, Agent, or Firm*—Haverstock, Garrett & Roberts

[57] ABSTRACT

A device for removing air from a toilet and deodorizing the air is disclosed which comprises an air intake member having an inlet end, an outlet end, and toilet rim engaging member for holding the inlet end adjacent to the toilet bowl, a filter canister havin g a base portion and a top which is movable relative to the base portion, the filter canister having an internal cavity, an inlet opening, and one or more outlet openings, the inlet opening connected to the second end of the intake member, a fan positioned within the filter canister, a first filter member positioned in the internal cavity of the filter canister for filtering hair, lint and large particulates from the air, a second filter member positioned in the filter canister and including a mesh bag containing a quantity of filtering media, the mesh bag being press fit into a portion of the internal cavity such that the mesh bag forms to the cross-sectional shape of the filter canister, the fan for drawing air in through the air intake member inlet end, through the inlet opening of the filter canister, through the first filter member, through the second filter member, and out of the filter canister through the outlet opening thereof such that the air flowing out of the outlet opening is deodorized.

20 Claims, 4 Drawing Sheets

DEVICE FOR DEODORIZING AIR FROM A TOILET

CROSS-REFERENCE TO RELATED APPLICATION

This application is a continuation-in-part of U.S. patent application Ser. No. 08/405,215 filed on Mar. 16, 1995 now abandoned.

BACKGROUND OF THE INVENTION

The present invention relates to a device for ventilating and deodorizing the air from toilets, urinals, bed pans and other receivers and holders of urine and fecal matter, and more particularly, to a ventilating and deodorizing device which utilizes a convenient and easily positionable member which is filled with a highly effective odor filtering media.

Various devices are known and have been proposed in the past for removing and deodorizing the air from a toilet. Some of such devices are disclosed in U.S. Pat. Nos. 3,491,382, 3,571,824, 3,790,970, 3,857,119, 4,059,857, and 5,125,119, which disclose toilet ventilating and deodorizing devices, some of which include removable members or cartridges containing filtering media through which the toilet air is directed for filtering and deodorizing. However, in such devices, the filtering media has a tendency to shift or settle during operation such that the air to be deodorized may end up passing through only a limited amount of the filtering media or such that some air actually bypasses the filtering media altogether. Further, in such devices lint, hair, and other particulates have a tendency to build up on the filtering media such that the ability of the air to pass through the filtering media is restricted. In such devices it may be necessary to change or adjust the filtering media more frequently than desirable in order for the devices to most effectively filter and thereby deodorize the air.

Another problem associated with known toilet ventilating and deodorizing devices is improper control of air intake of such devices. Such devices may take in air too quickly resulting in turbulent air flow in and around the toilet with the turbulent airflow resulting in spreading the odorous air. On the other hand, if the air intake rate is too slow, such devices may not take in air at a sufficient rate to effectively ventilate and deodorize.

Additionally, many known toilet ventilating and deodorizing devices utilize activated charcoal as the filter media, which has been found to be less effective than the preferred filter media disclosed in the present invention.

The present invention is designed to obviate and overcome many of the disadvantages and shortcomings experienced with the toilet deodorizing devices discussed hereinbefore and with other toilet deodorizing devices used in the past, and to provide a toilet deodorizing device which can be easily utilized.

SUMMARY OF THE INVENTION

The present invention teaches the construction and operation of a device for ventilating and deodorizing air from a toilet that utilizes a first filter member for filtering lint, hair, and other large particulates from the air prior to the air reaching a second filter member which includes a filtering media contained in a mesh bag. The first and second filter members are located in a filter canister and the mesh bag of the second filter member is preferably configured for covering the entire surface area of a cross-section of the canister such that the filtering media is evenly distributed there-across. Particularly, the mesh bag, filled with the filtering media, can be placed in the canister such that the bag forms to the shape of the canister, assuring that the filtering media is dispersed across the entire cross-section thereof and preventing incoming air from passing around the filtering media. Further, the mesh bag is preferably tightly packed with the filtering media so as to prevent excessive settling of the filtering media during use. The filtering media and the mesh bag are not harmful to the environment and may safely be disposed of after use.

The preferred filtering media according to the present invention is an inorganic oxidizer in pellet or crystal form made from a combination of powdered activated alumina and other binders impregnated with potassium permanganate. This preferred filtering media has been found to provide effective adsorption, absorption and oxidation of gases and fumes compared to other known media. Further, the preferred inorganic oxidizer filtering media, unlike activated charcoal and other filtering media, is not combustible or flammable. One example of a preferred inorganic oxidizer filtering media is the Purafil II® family of products made by Purafil, Inc. of Norcross, Ga.

In a preferred embodiment of the present invention, a device for removing air from a toilet and deodorizing the air includes an air intake manifold having an inlet end, an outlet end, and toilet rim engaging means for holding the inlet end adjacent to the toilet bowl in a position above the rim of the toilet bowl, a flexible intake hose having first and second ends, the first end attached to the outlet end of the air intake manifold, a filter canister having a base portion and a top which is movable relative to the base portion, the filter canister having an internal cavity, an inlet opening, and one or more outlet openings, the inlet opening connected to the second end of the flexible intake hose, air moving means positioned within the filter canister, a first filter member positioned in the internal cavity of the filter canister for filtering hair, lint and large particulates from the air, a second filter member positioned in the filter canister and including a mesh bag containing a quantity of filtering media, the mesh bag being press fit into a portion of the internal cavity such that the mesh bag forms to the cross-sectional shape of the filter canister, the air moving means drawing air in through the air intake manifold inlet end, through the flexible intake hose, through the inlet opening of the filter canister, through the first filter member, through the second filter member, and out of the filter canister through the outlet opening thereof such that the air flowing out of the outlet opening is deodorized.

In another preferred embodiment of the present invention, a device for removing air from a receiver of urine and/or fecal matter and deodorizing the air includes an air intake manifold having an inlet end, an outlet end, and means for holding the inlet end adjacent to the receiver, a flexible intake hose having first and second ends, the first end attached to the outlet end of the air intake manifold, a filter canister having a base portion and a top which is movable relative to the base portion, the filter canister having an internal cavity, an inlet opening, and an outlet opening, the inlet opening connected to the second end of the flexible intake hose, air moving means positioned within the filter canister, a first filter member positioned in the filter canister for filtering hair, lint and large particulates from the air, a second filter member positioned in the filter canister and including a mesh bag containing a quantity of filtering media, the mesh bag being press fit into a portion of the internal cavity such that the nylon mesh bag forms to the cross-sectional shape of the filter canister, the air moving means drawing air in through the air intake manifold inlet end, through the flexible intake hose, through the inlet opening of the filter canister, through the first filter member, through the second filter member, and out of the filter canister through the outlet opening thereof such that the air flowing out of the outlet opening is deodorized.

In the preferred embodiments of the present invention it is also considered important to select the proper combination of an air moving member and an air intake member in order to achieve an effective, yet non-turbulent air intake rate. Thus, the airflow rate caused by the air moving member and the size, shape, and positioning of the air intake member are important considerations.

A principal object of the present invention is to provide means for ventilating and deodorizing a toilet more effectively than prior art devices.

Another object of the present invention is to provide a toilet deodorizing device which includes first and second filter members, the first filter member for removing lint, hair, and large particulates from the air, and the second filter member including an improved filtering media contained within a mesh bag which allows the filtering media to form fit a filter canister in which it is located in order to provide maximum airflow through the filtering media and to limit settling of the filtering media during operation of the device.

Yet another object of the present invention is to provide a toilet deodorizing device which provides sufficient air intake for effective deodorizing without causing excessive turbulent airflow.

These and other objects of the present invention will become apparent to those skilled in the art after considering the following detailed specification in conjunction with the accompanying drawings.

DETAILED DESCRIPTION OF THE PREFERRED EMBODIMENTS

Figure 1:
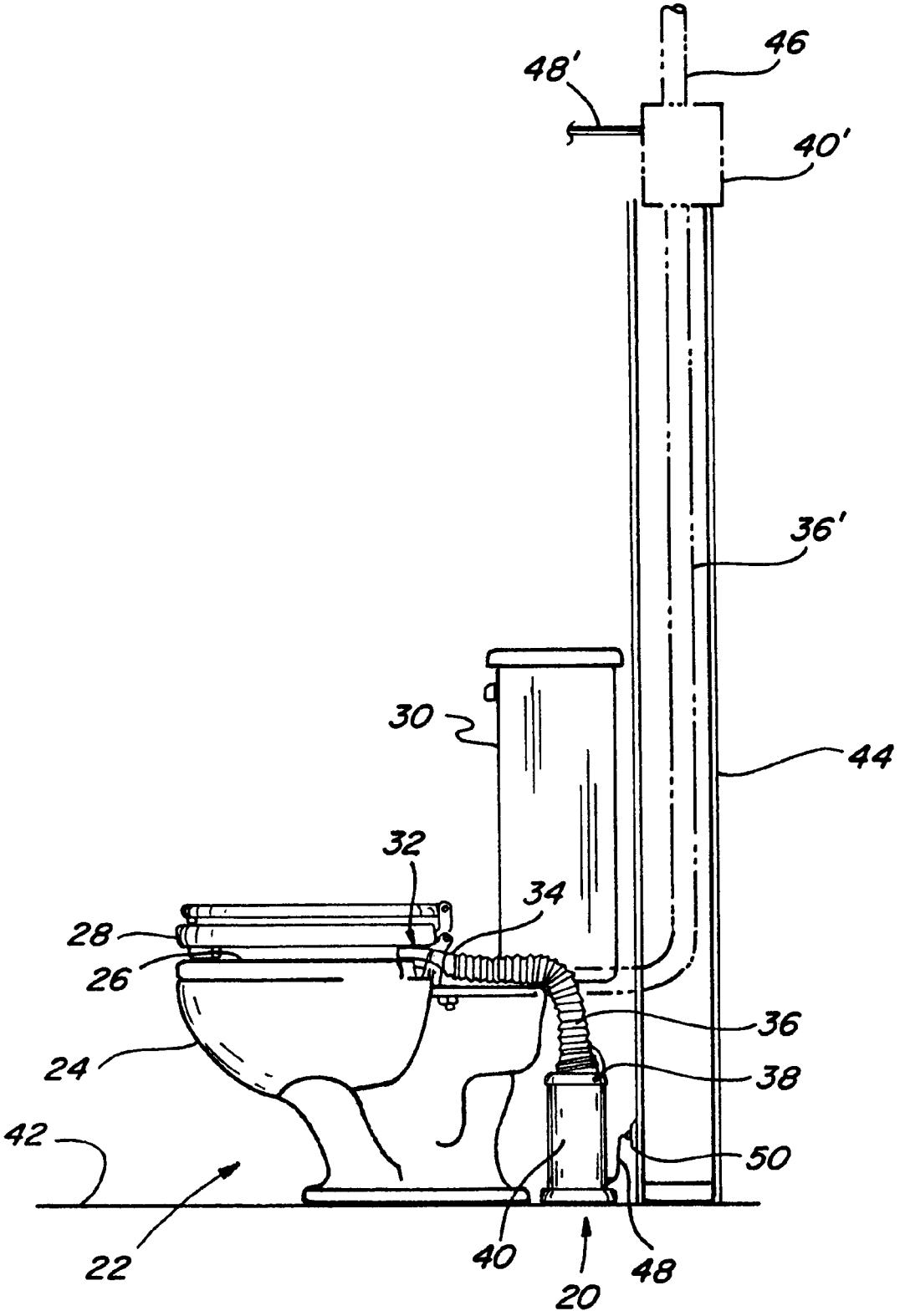
FIG. 1 is a side elevational view showing a conventional toilet in association with a toilet ventilating and deodorizing device according to the present invention with the ventilating and deodorizing device shown in solid lines at a first location on the floor adjacent the toilet and in phantom at a second location in a wall behind the toilet.

Referring to the drawings more particularly by reference numbers wherein like numerals refer to like parts, the numeral 20 identifies a preferred embodiment of a toilet ventilating and deodorizing device of the present invention, which embodiment, is depicted in FIG. 1 in association with a conventional toilet 22. The toilet includes a toilet bowl 24 having an upper rim or lip portion 26 extending around an upwardly open cavity formed by the bowl 24. A toilet seat and lid assembly 28 is hingedly attached to the toilet bowl 24 and is positionable in a first position resting on or overlaying rim 26, as shown, and a second upright position, as is well known. The toilet 22 further includes a tank 30 supported rearward of the toilet bowl 24 for holding a quantity of water for flushing purposes. The present toilet ventilating and deodorizing device 20 includes an air intake manifold 32 positioned on the toilet bowl rim 26, adjacent the toilet bowl 24, for collecting air. The intake manifold 32 is coupled to a first end 34 of a flexible intake hose 36. The intake hose 36 has a second, opposite end 38 which is coupled to a filter canister 40. The filter canister 40 is shown in one location on a floor 42 behind the toilet 22. However, the canister 40 can also be placed at other locations, such as above a wall 44, as shown by the hose 36' and the canister 40', and can include an exhaust conduit such as a hose 46 for exhausting air to a remote location. The device 20 further includes a power cord 48 that can be plugged into a standard electrical outlet, such as an outlet 50, to power the device 20.

Figure 3:
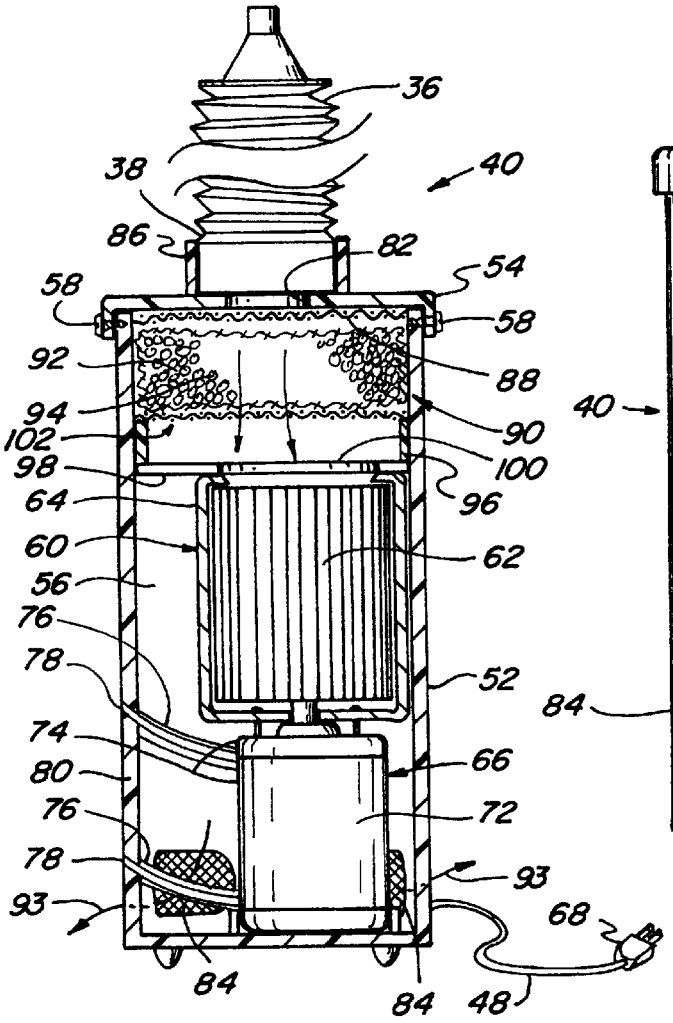
FIG. 3 is a cross-sectional view taken along the plane of line 3—3 of FIG. 2, showing the internal components of the toilet ventilating and deodorizing device.
Figure 4:
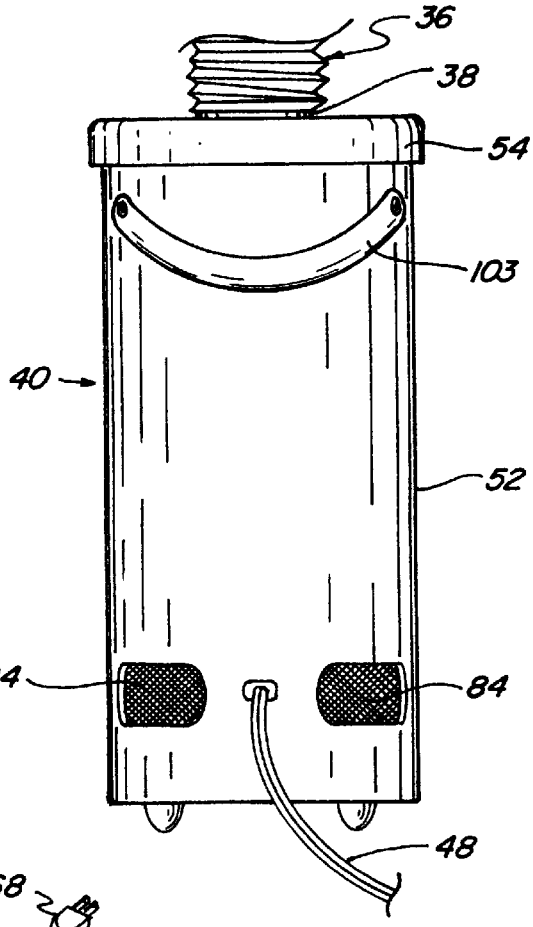
FIG. 4 is an enlarged rear view of the filter canister of FIG. 1.
Figure 2:
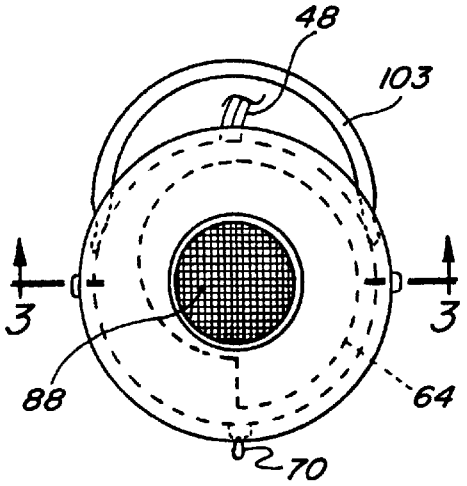
FIG. 2 is an enlarged partial top view of the toilet ventilating and deodorizing device of FIG. 1.

Referring to FIGS. 2, 3 and 4, the filter canister 40 is a columnar or cylindrical shaped member of tubular construction which includes a lower base portion 52 and a lid portion 54. The base portion 52 and the lid portion 54 together define an internal cylindrical shaped cavity 56. The lid 54 is attached to the base 52 by screws 58 which extend through the lid 54 into the side of the base 52. A fan assembly 60 is located in the base portion 52 and includes a squirrel cage type fan 62 and associated housing 64. A motor 66 is mounted adjacent the lower end of the cavity 56. The fan assembly 60 has wired to it the electrical power cord 48 having a plug 68 for plugging into the electrical outlet 50, as mentioned above. A power switch 70 is wired in association with the cord 48 and the motor 66 for operation of the motor 66. Alternatively, the motor 66 could be battery powered or the switch 70 could be located elsewhere, such as on the bathroom wall 44 or the like. The motor 66 has a housing 72 which includes two openings 74 for oiling the motor 66. Extending from each of these openings 74 is a corresponding tubular member 76, which may comprise plastic tubing. Each tubular member 76 extends to a corresponding hole 78 in the side 80 of the base 52, and may be attached at the ends by various known means such as adhesive. Preferably, the location of each hole 78 in the base sidewall 80 is at a height greater than the height of the corresponding hole 74 in the motor housing 72 such that each tubular member 76 extends from the side 80 of the base 52 downward toward the motor 66. In such a construction oil may be injected directly into the holes 78 in the side 80 of the base 52 whereupon such oil will run down the corresponding tubular member 76 and into the corresponding opening 74 in the motor housing. This construction provides for simple, routine oiling of the motor 66 in order to increase the working life of such motor 66. With respect to the motor 66 and fan assembly 60, it is preferred that a combination which provides an airflow rate of approximately 120 CFM to 160 CFM be utilized in order to minimize turbulent airflow near the toilet bowl 24.

An intake opening 82 is formed on the top of the lid 54 and one or more outlet openings 84 are formed in the side 80 of the base 52, preferably near the bottom and rear thereof. The second end 38 of the intake hose 36 is attached to a flange 86 located around the intake opening 82 by using any suitable means such as frictional engagement, a clamp (not shown), an adhesive or the like to prevent air leakage. In the same regard, a gasket (not shown) may extend around the interface between the base 52 and the lid 54 to prevent air leakage between the base 52 and the lid 54. However, if the fit between the base 52 and the lid 54 is sufficiently tight, a gasket may not be necessary.

The filter canister 40 has positioned therein a first filter member 88 located substantially adjacent the intake opening 82 of the lid 54. This first filter member 88 preferably comprises a separate screen, which may be formed from wire mesh, where the openings in the screen are small enough so that lint, hair, and other large particulates cannot pass therethrough and are therefore trapped on the first filter member 88. In this regard, a 1/16" or smaller size mesh is preferred for the first filter member 88. Importantly, the first filter member 88 may be removed from the canister 40 and cleaned without requiring removal of any filtering media. Also positioned near the top of the base 52 is a second filter member 90 which includes a mesh bag 92 containing a quantity of filtering media 94. The mesh bag 92 is preferably of similar shape to that of the filter canister 40 cross-section, formed from a durable material such as nylon, and is tightly packed with the filtering media 94. The internal cavity 56 of the filter canister includes a support member 96 extending therearound, which support member 96 may rest on the top surface of the housing 64 of the fan assembly 60. Alternatively, the support member 96 may sit upon a cylindrical sealing member 98 which includes an opening 100 substantially aligned with the opening of the fan assembly 60, or one or more support members may be attached to the internal surface of the side 80 of the base 52. Positioned on the top of the support member 96 is a filter support screen 102 for supporting the second filter member 90. The filter support screen 102 includes openings therethrough. In this regard, a 1/8" wire mesh has been found sufficient to support the second filter member 90. The mesh bag 92 is placed on the filter support screen 102 and pressed thereagainst such that the filtering media 94 extends across the cross-section of the base 52 and against the side 80 of the base 52. Further, it is preferred that the lid 54 and the filter support screen 102 be positioned sufficiently close to one another such that when the first filter member 88 and the second filter member 90 are positioned therebetween, both filter members 88 and 90 are held tightly in place when the lid 54 is secured to the base 52. Such a construction assures that the filtering media 94 will remain distributed across substantially the entire cross-section of the base 52 and also helps to prevent the filtering media 94 from settling during operation, thus providing a construction in which the air to be filtered will pass through a sufficient amount of filtering media 94 to provide effective deodorizing thereof.

The preferred filtering media 94 is a commercially available inorganic oxidizer available in pellet or crystalline form which can adsorb, absorb and oxidize gases and other contaminants. An example of one preferred media is Purafil® brand inorganic oxidizers made from a combination of powdered activated alumina and other binders impregnated with potassium permanganate in pellet form.

Figure 5:
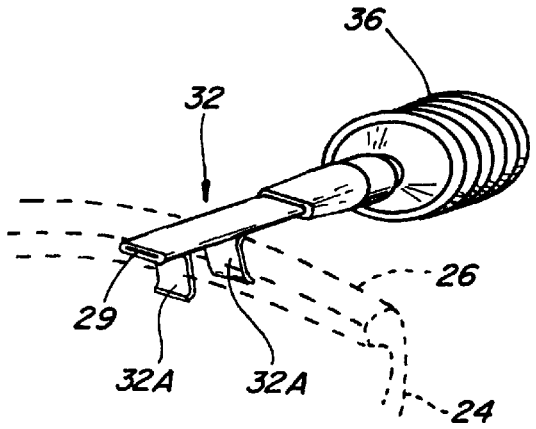
FIG. 5 is an enlarged perspective view of an intake manifold of the toilet ventilating and deodorizing device of FIG. 1 mounted over the toilet rim of a toilet bowl, where the toilet rim and toilet bowl are partially illustrated in dashed lines.

As shown in FIG. 5, the intake manifold 32 is constructed for positioning on the rim 26 of the toilet bowl 24 and includes two downwardly extending flange members 32A. Flange members 32A are spaced from each other, and are sufficiently resilient, such that when the manifold 32 is placed over the rim 26 of the toilet bowl 24, the flange members 32A engage the toilet bowl and securely hold the intake manifold 32 thereon. In this position, an input end 29 of the intake manifold 32 is located above the rim 26 of the toilet bowl 24 such that if the water in the toilet bowl 24 overflows, such water will not enter the inlet end 29 of the manifold 32.

In operation, activation of the fan assembly 60 will cause air to flow into the intake manifold 32, through the intake hose 36, into the filter canister 40 and through the first filter member 88 where lint, hair and other particulates are filtered, through the second filter member 90 and through the filtering media 94 thereof where the air is deodorized, into the top of the fan housing, out of the fan assembly 60 and downward past the motor 66 and through the outlet openings 86 as indicated by a pair arrows 93 in FIG. 3. Importantly, as the air passes by the motor 66 the air cools the motor 66. Filter canister 40 is portable and in this regard includes a carrying handle 103 attached to the outer surface of the side 72 of the base 52 as best shown in FIGS. 2 and 4.

Figure 6:
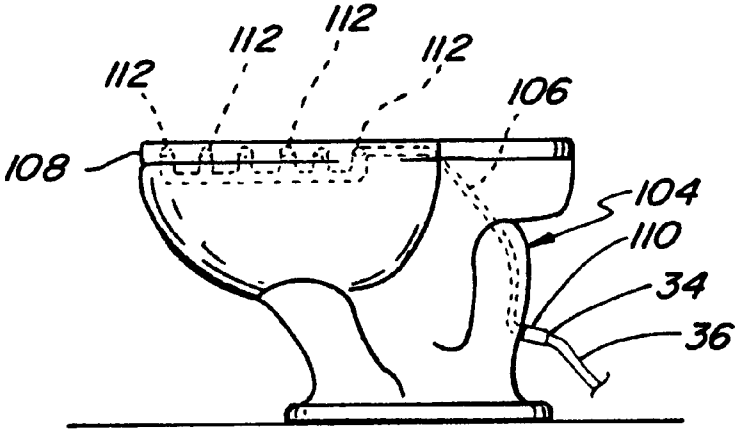
FIG. 6 is a side elevational view of a toilet constructed according to the present invention, including an air intake manifold integrally formed around the toilet bowl.

FIG. 6 shows an alternative toilet construction 104 having an integrally formed intake manifold 106 extending around at least a portion of a toilet bowl rim 108 and through the body of the toilet 104 to a coupler 110 for coupling to first end 34 of the intake hose 36. The intake manifold 106 can be molded into the toilet at the time of manufacture and includes a plurality of holes 112 at spaced locations around the rim 108 for receiving toilet air. The coupler 110 is mated to the first end 34 of the hose 36 which in turn is connected to the device 20 (not shown).

Figure 7:
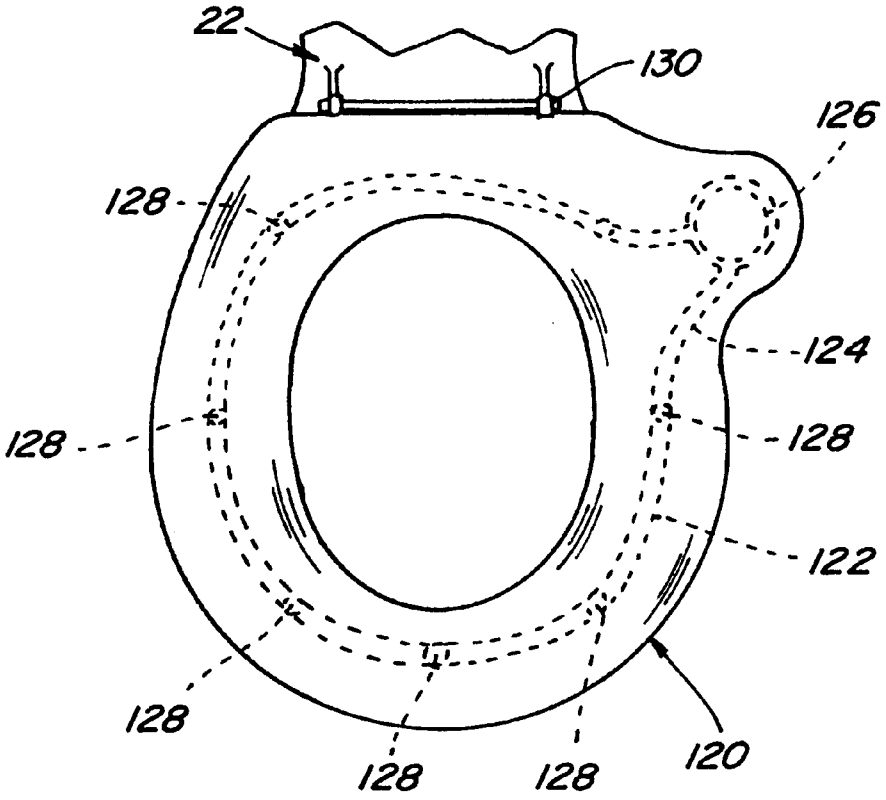
FIG. 7 is a top view of a toilet seat constructed according to the present invention, including an integrally formed air intake manifold.

FIG. 7 depicts a modified toilet seat 120 which is adapted to be used with the toilet 22 and which includes an integrally formed intake manifold 122. The intake manifold 122 is formed by providing a passageway 124 extending around the seat 120. The manifold 122 also has a coupler 126 which is attachable to the hose 36. The seat 120 includes a plurality of holes 128 therethrough communicating with the intake manifold 122 on the side of the seat 120 positionable adjacent the toilet bowl 24 for collecting toilet air. The seat 120 is shown hingedly attached to the toilet 22 in the conventional manner with a hinge 130. The toilet seat 122 is easily adapted to be used with an existing toilet 22 and no further modifications are required other than replacement of the toilet seat 28. The device 20 is connected to the hose 36 as has been described and air is drawn through the holes 128, the manifold 122, and the coupler 126 to the hose 36.

Figure 8:
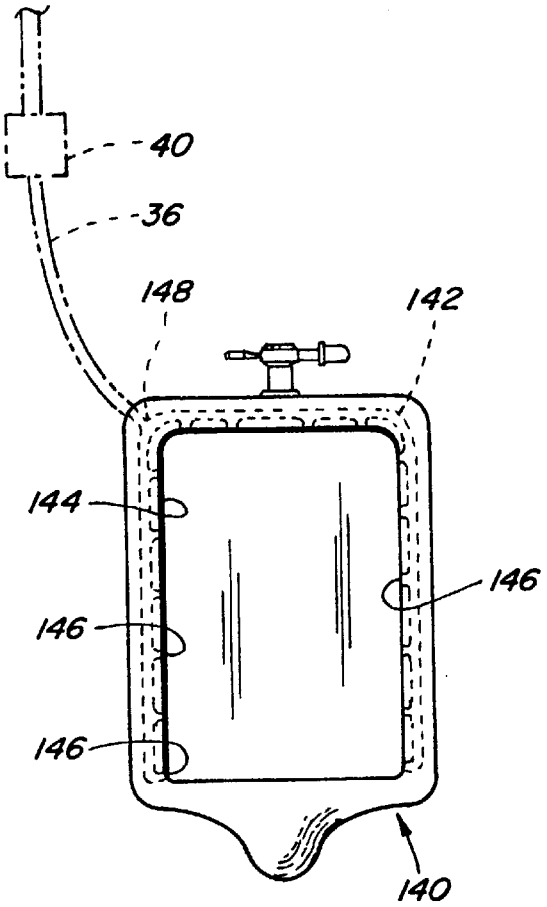
FIG. 8 is a front elevational view of a urinal constructed according to the present invention, including an integrally formed intake manifold.

FIG. 8 shows a modified urinal 140 having an integrally formed intake manifold 142 extending around at least a portion of a rim 144 of the urinal 140. The rim 144 includes a plurality of holes 146 communicating with the intake manifold 142. The urinal 140 includes a coupler 148 which is connected to the manifold 142. The coupler 148 is adapted to be connected to the intake hose 36 with the intake hose 36 being connected to the filter canister 40. The modified urinal 140 is an illustration of how the device 20 may be used in conjunction with the urinal 140 instead of the toilet 22.

Figure 9:
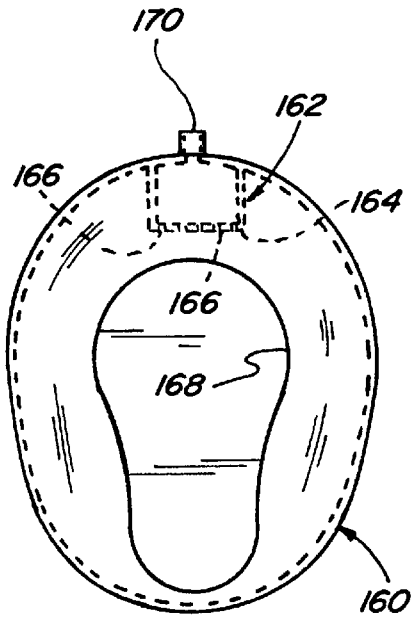
FIG. 9 is a top view of a bed pan constructed according to the present invention, including an integrally formed air intake manifold associated therewith.

Referring now to FIG. 9, a bed pan 160 of conventional shape and construction is illustrated which has been modified to include an integrally formed intake manifold 162 formed by a wall portion 164. A plurality of intake holes 166 are formed in the wall portion 164 adjacent to a central opening 168 of the bed pan 160 for collecting air to be filtered and deodorized. The bed pan 160 includes a coupler 170 which is adapted to have the intake hose 36 (not shown) placed thereon as previously described. In this manner, the bed pan 160 may be connected to the device 20 to filter and deodorize the air in and around the bed pan 160.

Figure 10:
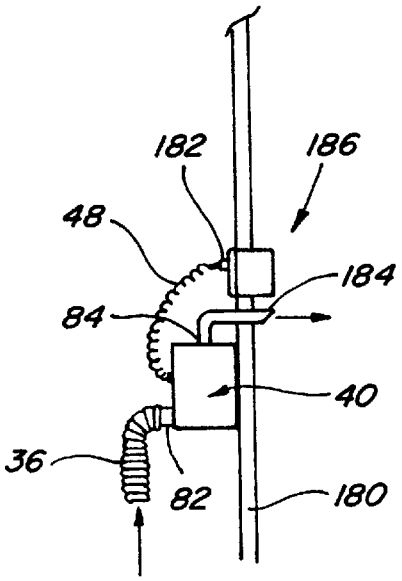
FIG. 10 shows a toilet ventilating and deodorizing device according to the present invention installed on a wall.

FIG. 10 illustrates another alternative mounting location for the filter canister 40. The filter canister 40 is shown mounted on the bathroom side of a wall 180 using any suitable conventional fastener means such as screws or the like and the power cord 48 is shown plugged into a wall outlet 182. The canister 40 includes a short outlet hose 184 connected to the outlet 84 of the canister 40 through which exhaust air from the canister 40 can be vented into an internal wall cavity or adjoining room 186. Additionally, the hose 36 is shown connected to the inlet 82 of the canister 40.

Thus, there has been shown and described a toilet ventilating and deodorizing device which fulfills all of the objects and advantages sought therefor. It will be apparent to those skilled in the art, however, that many changes, modifications, variations, and other uses and applications of the subject device are possible and contemplated. All changes, modifications, variations, and other uses and applications which do not depart from the spirit and scope of the invention are deemed to be covered by the invention which is limited only by the claims which follow.

I claim:

1. A device for removing air from a toilet and deodorizing the air, the device comprising:

an air intake member having an inlet end and an outlet end with the inlet end adapted to be positioned adjacent to the toilet, and a canister having a base portion and a removable top having an intake opening, an internal cavity, an inlet opening, and an outlet opening, the inlet opening connected to the outlet end of the air intake member, air moving means positioned in the cavity, a first filter member positioned within the internal cavity substantially adjacent to the intake opening of the top and separate from the removable top, a second filter member positioned within the internal cavity between the first filter member and the outlet opening and separate from the removable top, the second filter member including a quantity of filtering media, the air moving means for drawing air from the toilet through the inlet end of the air intake member, through the first filter member where lint, hair and other large particulates are retained in the intake opening of the top and on the first filter member and prevented from passing into the canister, and through the second filter member and the quantity of filter media thereof such that the air is deodorized as it passes therethrough, and out through the outlet opening, the first filter member being positioned between the second filter member and the inlet opening, and the first filter member being removable through the inlet opening once the removable top is removed from the base portion without requiring removal of the second filter member.

2. The device of claim 1 wherein the first filter member comprises a mesh screen positioned adjacent the inlet opening of the canister, the mesh screen adapted to be removed from the canister to provide cleaning thereof.

3. The device of claim 1 wherein the second filter member comprises a mesh bag containing the quantity of filtering media.

4. The device of claim 3 wherein the mesh bag of the second filter member is formed from a durable nylon material.

5. The device of claim 3 further comprising means for supporting the second filter member within the internal cavity of the canister, the second filter member forming to a cross-sectional shape of the canister such that the filtering media is distributed across the cross-sectional shape of the canister.

6. The device of claim 5 wherein the means for supporting the second filter member is positioned with respect to the canister top such that the first filter member and the second filter member are held tightly therebetween so that settling of the filtering media during operation of the device is minimized.

7. The device of claim 1 wherein the air moving means comprises a fan assembly and a motor operably attached to the fan assembly, the motor including a housing having at least one opening therein for oiling the motor interior, the canister including at least one hole in the base portion and means for providing oil from the hole in the base portion to the opening in the motor housing.

8. The device of claim 7 wherein the means for providing oil from the hole in the base portion to the opening in the motor housing includes a tubular member extending from the hole in the base portion to the opening in the motor housing, wherein the hole in the base portion is positioned higher than the opening in the motor housing.

9. The device of claim 1 wherein the intake member comprises toilet rim engaging means including at least two flange members for holding the inlet end of the intake member on the toilet bowl.

10. The device of claim 1 wherein the filtering media is an inorganic oxidizer filtering media which includes activated alumina impregnated with potassium permanganate.

11. A device for removing air from a receiver for urine and fecal matter and deodorizing the removed air, the device comprising:

an air intake member having an inlet end and an outlet end with the inlet end adapted to be positioned adjacent to the receiver, and a canister having a base portion and a removable top having an intake opening, an internal cavity, an inlet opening, and an outlet opening, the inlet opening connected to the outlet end of the air intake member, air moving means positioned in the cavity, a first filter member positioned within the internal cavity substantially adjacent the removable top and the intake opening, a second filter member positioned within the internal cavity between the first filter member and the outlet opening, the second filter member including a mesh bag containing a quantity of filtering media, the air moving means for drawing air from the toilet through the inlet end of the air intake member, through the first filter member where lint, hair and other large particulates are retained in the intake opening of the top and on the first filter member and prevented from passing into the canister, and through the second filter member and the quantity of filter media thereof such that the air is deodorized as it passes therethrough, and out through the outlet opening, the first filter member being positioned between the second filter member and the inlet opening, and the first filter member being removable from the base portion through the inlet opening once the top is removed without requiring removal of the second filter member.

12. The device of claim 11 wherein the first filter member comprises a mesh screen adapted to be removed from the canister to provide cleaning thereof.

13. The device of claim 11 wherein the mesh bag of the second filter member is formed from a durable nylon material.

14. The device of claim 13 further comprising means for supporting the second filter member within the internal cavity of the canister, the second filter member forming to a cross-sectional shape of the canister such that the filtering media is distributed across the cross-sectional shape of the canister.

15. The device of claim 14 wherein the means for supporting the second filter member is positioned with respect to the canister top such that the first filter member and the second filter member are held tightly therebetween when the top of the canister is secured to the base so that settling of the filtering media during operation of the device is minimized.

16. The device of claim 11 wherein the filtering media is an inorganic oxidizer filtering media which includes activated alumina impregnated with potassium permanganate.

17. A device for removing air from a toilet and deodorizing the air, the device comprising:

an air intake manifold having an inlet end and an outlet end with the inlet end adapted to be positioned adjacent to the toilet, a flexible intake hose including a first end and a second end, the first end attached to the outlet end of the air intake manifold, and a canister having a base portion and a top having an intake opening, an internal cavity, an inlet opening, and an outlet opening, the intake opening connected to the second end of the flexible intake hose, air moving means positioned in the cavity, a first filter member loosely positioned within the internal cavity substantially adjacent the top and the intake opening, a second filter member positioned within the internal cavity between the first filter member and the outlet opening, the second filter member including a quantity of filtering media, the air moving means for drawing air from the toilet through the inlet end of the air intake manifold, through the flexible intake hose, through the first filter member where lint, hair and other large particulates are retained in the intake opening of the top and on the first filter member within the flexible intake hose and prevented from passing into the canister, through the second filter member and the quantity of filter media thereof such that the air is deodorized as it passes therethrough, and out through the outlet opening, the first filter member being loosely positioned between the second filter member and the top, the top being removable from the base portion and the first filter member being removable from the base portion through the inlet opening once the top is removed from the base portion without requiring removal of the second filter member.

18. The device of claim 17 wherein the first filter member comprises a mesh screen positioned adjacent the inlet opening of the canister, the mesh screen adapted to be removed from the canister to provide cleaning thereof.

19. The device of claim 17 wherein the second filter member comprises a durable nylon mesh bag containing the quantity of filtering media.

20. The device of claim 17 wherein the air moving means includes a fan assembly and a motor operably attached thereto, the deodorized air being directed past the motor such that the air cools the motor before passing out through the outlet opening.

* * * * *